US005308248A

United States Patent [19]

Davidge et al.

[11] Patent Number: 5,308,248

[45] Date of Patent: May 3, 1994

[54] HIGH DENSITY INTERCONNECTION SYSTEM

[75] Inventors: Ronald V. Davidge, Coral Springs; Todd A. McClurg; Jay H. Neer, both of Boca Raton; Richard J. Nelson, Boynton Beach; Darryl C. Newell, Boca Raton, all of Fla.; Rocco J. Noschese, Wilton; Ronald P. Sidor, Stratford, both of Conn.

[73] Assignee: International Business Machines Corp., Armonk, N.Y.

[21] Appl. No.: 937,256

[22] Filed: Aug. 31, 1992

[51] Int. Cl.[5] ..... H01R 23/70

[52] U.S. Cl. ..... 439/59; 439/79; 439/924

[58] Field of Search ..... 439/59-62, 439/65, 101, 108, 629, 630, 631, 636, 637, 924, 79, 80

[56] References Cited

U.S. PATENT DOCUMENTS

| | | | |
|---|---|---|---|
| 3,432,795 | 3/1969 | Jayne | 439/60 |
| 3,950,068 | 4/1976 | Schmieg | 439/746 |
| 4,331,370 | 5/1982 | Andrews | 439/75 |
| 4,392,705 | 7/1983 | Andrews, Jr. et al. | 439/79 |
| 4,550,959 | 11/1985 | Grabbe et al. | 439/59 |
| 4,659,155 | 4/1987 | Walkup et al. | 439/79 |
| 4,715,820 | 12/1987 | Andrews, Jr. et al. | 439/59 |
| 4,824,383 | 4/1989 | Lemke | 439/108 |
| 4,846,734 | 7/1989 | Lytle | 439/637 |
| 4,934,961 | 6/1990 | Piorunneck et al. | 439/637 |
| 4,936,785 | 6/1990 | Krug et al. | 439/75 |
| 5,082,459 | 1/1992 | Billman et al. | 439/637 |
| 5,129,832 | 7/1992 | Marsh et al. | 439/79 |
| 5,139,426 | 8/1992 | Barkus et al. | 439/65 |

OTHER PUBLICATIONS

Dupont Electronics Catalog 88-B, pp. 374-390.

*Primary Examiner*—Neil Abrams

*Attorney, Agent, or Firm*—Richard A. Tomlin; Ronald V. Davidge

[57] ABSTRACT

A daughter card is provided with an insertion portion, including a row of contact pads on each side of an edge prepared for insertion into the slot of card edge connector, and a contact structure extending from one or both sides of the card. Contact terminals of the contact structure extend parallel to the insertion portion of the card, being electrically connected to circuits within the card. On a mother board, a connector is provided with a first slot for removably receiving the insertion portion of the daughter card, and with one or two slots for removably receiving the contact terminals. The mother board and the daughter card include essential circuits, which are connected through the contact pads, and non-essential circuits, which are connected through the contact terminals. The daughter card may be plugged into a standard type of card edge connector, having only a single, central card-receiving slot, with the contact terminals extending outside the outer surfaces of the connector. A standard type of daughter card, with contact pads on an insertion portion but without the contact terminals extending outward from the card, can be plugged into the first slot of the connector.

5 Claims, 3 Drawing Sheets

HIGH DENSITY INTERCONNECTION SYSTEM

BACKGROUND OF THE INVENTION

1. Field of the Invention

This invention relates to electrical connectors and, more particularly, to interconnection systems providing an increased number of circuits by means of multiple rows of contacts, where it is desirable to maintain compatibility with components having fewer interconnect circuits.

2. Cross-Reference to Related Applications

U.S. Pat. Nos. 5,096,435 and 5,197,887, and copending application Ser. No. 07/990,812 describe high density edge card connection apparatus which includes a connector configured to receive a portion of a daughter card in a central slot, and a daughter card having two rows of contact pads adjacent to an insertion edge, on each side of the card. The connector has two rows of contact springs on each side of the central slot, extending into the central slot to contact the associated rows of contact pads on an inserted daughter card, supported in position by an insulative housing, and extending outward therefrom to be soldered to various circuits in a mother board.

These applications describe solutions for the problems associated with increasing the density of an interconnection system having a single row of contact pads on each side of the daughter card and a single row of contact springs on each side of the central slot of the connector, wherein the increase in density is made by adding a second row of contact pads on each side of the card and a second row of contact springs on each side of the central slot in the connector, and wherein it is necessary to maintain interchangeability between both cards and connectors of the new and old types. This concept is applied where forethought about an eventual need to increase the density of the interconnection in this way has not occurred; daughter cards of the old type have various conductive surfaces in the space where the new rows of contacts must be placed. To allow the use of such old types of cards in the new connectors, means must be provided to prevent contact between the new, additional rows of contact springs and the adjacent surfaces of such a card as it is inserted into the connector.

In U.S. Pat. No. 5,197,887, interposing means are provided to hold these contact springs out of contact with the card in this situation. In a first embodiment, such interposing means consist of insulative camming surfaces slid into place over this space in the card before the card is inserted into the connector. In a second embodiment, such interposing means consists of an interposer pivotably mounted in the connector at each side of the central slot, to be rotated into a position holding the new, additional rows of contact springs out of electrical contact with the card whenever an old type of daughter card is inserted.

In U.S. Pat. No. 5,096,435 and copending application Ser. No. 07/990,812, the new rods of contact spring are formed so that they hold themselves out of contact with an inserted daughter card. The insertion of a card of the new type causes the sliding of an actuator which moves these springs into contact with the card.

BACKGROUND INFORMATION

Computer systems typically include a mother board common to a number of configurations, and one or more daughter cards used to provide system features required for individual system configurations. Various circuits operate through connectors removably attaching the daughter cards to the mother board. Daughter cards can be used, for example, to provide, on interchangeable adapter cards, circuits operable with various optional types of peripheral devices, or to provide, on interchangeable processor cards, a choice among various types of central processor circuits.

One common, and particularly successful, method for providing an interconnection between such daughter cards and a mother board is the edge card connection, where a portion of a daughter card is inserted into a central slot of a connector attached to the mother board. This portion of the card includes, on each side, a row of contact pads adjacent to the insertion edge, with various of these contact pads electrically attached to various circuits in the card the connector includes a number of springs, extending from each side of the central slot to make electrical contact with these pads on the inserted portion of the daughter card. The contact springs are supported in the insulative housing and extend outward therefrom as solder tails to be attached to various circuits within the mother board.

Significant trends in the computer industry have resulted in the development of ever-smaller circuit components, which provide additional function in a system without increasing its physical size, but which increase the complexity of the associated circuitry so that more interconnection lines are needed.

Sometimes this need for additional lines has been satisfied by decreasing the distance between the center lines of contacts in a connection system, so that more contacts can be accommodated in the same length of connector. For example, while the bus of the original "IBM Personal Computer" systems is connected to daughter cards through connectors having a space of 0.100 inch between contact centers, the daughter cards of the more recent "IBM Personal System/2" systems is connected to daughter cards through connectors in which this spacing is 0.050 inch.

However, continued use of this approach has the disadvantages of increasing costs, as more precise parts are required for proper mating of the contacts, and of decreasing the reliability of the connections, due to dimensional variations in the parts. Furthermore, when this approach is used, the change in pitch, or center line distance, tends to lead to an incompatibility between different types of cards and connectors, so that daughter cards of the old type cannot be used in connectors of the new type, and so that daughter cards of the new type cannot be used in connectors of the old type.

An alternative method for increasing the density of an interconnection between a daughter card and a mother board is the provision of two or more rows of contact pads on each side of the portion which is inserted into the connector, and the provision of two or mote rows of contact springs on each side of the central slot of the connector. The problem of configuring a new type of connector to accept either a new type of daughter card of this kind, having two rows, or an old type of daughter card having a single row of contact pads on each side, has been solved in an interconnect configuration of the Electronic Industry Standards Association (EISA). In this configuration, the connector has two rows of contact springs on each side of the central slot, and a series of key bars extending across the slot in locations corresponding to key slots in the new type of daughter card. Thus, when a daughter card of the old type is pushed downward into the central slot of the new type of connector, its insertion edge comes to rest on a number of key bars, so the upper row of contact springs on each side of the central slot in the connector comes into contact with the only row of contacts on the adjacent side of the card. A daughter card of the new type can be fully inserted into the connector, with its key slots passing around the key bars, so that both upper and lower rows of contact springs are electrically connected to the adjacent rows of contact tabs on the card.

However, in order to achieve this kind of interchange-ability, it is necessary to assign essential connections between circuits within the mother board and daughter card to the only row of contact pads on each side of the old type of card, and hence to the upper row of contacts on each side of the new type of connector, since these are the only springs to be electrically connected to contact pads when a card of the old type is inserted. This means that cards of the new type must have these essential connections assigned to the upper rows on each side, and therefore that such cards cannot be used in connectors of the old type, where their essential connections would not be made, since the contacts pads associated with these connections would remain above the contact springs of a connector of the old type. The connections between the lower row of contact pads in the new type of card, and the lower row of spring contacts in the new type of connector, may be used for non-essential functions to increase the performance of the system and to provide non-essential features.

This means that, while old cards can be used in a system having connectors of the new type, cards of the new type cannot be used in a system having connectors of the old type. From the point of view of hardware of the old type, his investment in daughter cards is thus protected, since he can continue to use his old cards even if he purchases a new system having the new type of connectors. However, his investment in the system itself is not protected in this way, since he cannot install daughter cards of the new type in his old system with the old type of connectors.

DESCRIPTION OF THE PRIOR ART

U.S. Pat. No. 4,846,734, issued to Lytle on Jul. 11, 1989, describes a card edge connector configured to removably receive an edge of a printed circuit card in a central slot and to form a number of electrical connections between conductive pads, arranged in a single row along each side of the card adjacent to the edge inserted into the connector, and circuits within the mother board to which the connector is attached by soldering. To achieve this purpose, the connector uses a row of electrical contacts on each side of a central slot, where each contact includes a lower section formed as a solder tail, an intermediate section extending upward and inward from the lower section, an upper section extending upward and outward to define, at a bight, or curved region between the upper and intermediate sections, a contact region having a compound radius. That is, in this region, the contact surface curves away from the point at which contact is made in both directions. This shape can be fabricated by coining and bending. This patent further discloses a connector design having contacts of 0.050-inch centers on each side of the circuit card.

U.S. Pat. No. 4,934,961, issued to Piorunneck, et al. on Jun. 19, 1990, describes an interconnect configuration of the Electronic Industry Standards Association (EISA) including a connector which accepts either an old type of daughter card having one row of contact pads on each side or a new type of daughter card having two rows of contacts on each side, as described in the preceding section. In accordance with this patent, each contact in the lower row is formed so that, as the card is inserted in contact with an inner surface of the contact, the outer surface of the contact deflects until it reaches an inner surface of the insulating connector housing. Further deflection with continued card insertion occurs with higher forces, at a higher spring rate.

Another approach to the goal of interchangeability is taken U.S. Pat. No. 4,936,785, issued to Krug et al. on Jun. 26, 1990. This approach uses an interchangeable adapter module to be connected between a common pin interface, on a circuit board or other device to be added within a personal computer, and any one of several types of interfaces available in the computer.

U.S. Pat. No. 4,331,370, issued to Andrews et al. on May 25, 1982, describes a system for providing additional connection paths between a densely crowded printed circuit board, having an insertion edge configured for electrical termination in a card-edge connector, and additional card-edge connectors held within a card cage assembly. An additional card, having an edge adapted with conductive pads on each side for electrical termination in an additional card-edge connector, is attached by means of a module to each side of the printed circuit board, spaced apart therefrom to extend downward parallel to the insertion edge of the printed circuit board. Each module includes two rows of conductive pins, pressed into platedthrough holes in the printed circuit board and in the associated additional card, to carry electrical signals between the board and the card. Each module also includes an embedded conductive shield, extending between the rows of pins, having a number of spaced-apart integral pins extending outward through the additional card. Thus, three contact interface areas are provided---centrally, in the form of a conventional card edge connection, and outwardly, in the form of additional contact surfaces extending downward at each side of the card in a spaced-apart, parallel relationship with the insertion edge.

The concept of forming contact terminals with contact springs extending in a first direction from a daughter card, being held in place within insulating structures attached to the daughter card, wherein these contact terminals also have conductive structures extending inward and opposite this first direction to be held in contact with conductive pads on the side surfaces of the daughter card by pressure or by solder attachment, is discussed, for example, in U.S. Pat. No. 4,392,705, issued to Andrews, Jr. et al. on Jul. 12, 1983, in U.S. Pat. No. 4,715,820, issued to Andrews, Jr. et al. on Dec. 29, 1987, and in U.S. Pat. No. 4,824,383, issued to Lemke on Apr. 25, 1989. U.S. Pat. No. 4,659,155, issued to Walkup et al. on Apr. 21, 1987, applies this concept to spring receptacles held in rows in insulating structures. U.S. Pat. No. 4,715,820 to Andrews, Jr. et al. also describes the use a blade-shaped insulative structure to hold such contact springs. None of these patents describe the use of such contact structures along with contact pads adjacent to an edge inserted into a card-edge connector.

U.S. Pat. No. 4,550,959, issued to Grabbe et al. on Nov. 5, 1985, describes a modular connector made up of a number of axially aligned sections, each of which includes a coupling feature at each end to receive an adjacent section. In this example, modularity is applied to a surface-mount card-edge type of connector of variable length, in particular to allow thermal expansion and contraction between sections during the solder attachment process.

The use, within a connector, of contacts having different lengths is an optional part of the DuPont HPC Interconnect system, which is described on pages 374 through 390 of DuPont Electronics Catalog 88-B. This system includes various types of connectors including four rows of pins, and mating connectors including four rows of contact spring receptacles. As shown in this catalog on pages 382 and 383, pin connectors of this kind are available having pins of three different lengths, which therefore extend from a back surface of the connector to three different levels, so that, during the engagement of such connectors with mating receptacles, the deflection of groups of contact springs occurs at three different times.

SUMMARY OF THE INVENTION

In accordance with one aspect of the invention there is provided a daughter card assembly including a circuit card with an insertion edge conditioned for insertion into a card edge connector, a number of conductive circuit pads on the surface of each side of the card adjacent to the insertion edge, a number of conductive terminal elements held spaced away from the circuit card, and numbers of essential and non-essential electronic circuits on the circuit card. The contact terminals are held in position parallel to the circuit card and electrically insulated from one another. The contact terminals are part of terminal elements, which include sections extending inward to be connected individually to electrical circuit traces on the circuit card. The essential electronic circuits, which are electrically connected to various of the conductive circuit pads, are necessary for the proper functioning of the daughter card assembly in cooperation with various circuits attached thereto through the conductive circuit pads. The non-essential electronic circuits, which are electrically connected to various of the conductive terminal elements, are necessary for providing non-essential features of the daughter card assembly in cooperation with various additional circuits attached thereto through the conductive terminal elements.

BRIEF DESCRIPTION OF THE FIGURES

Preferred embodiments of the subject invention are hereafter described with specific reference being made to the following Figures, in which.

DETAILED DESCRIPTION

Figure 1:
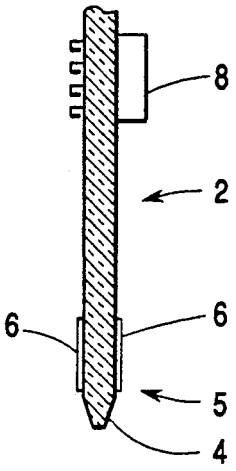
PRIOR ART Fig. 1.
FIG. 1 is a fragmentary transverse sectional view of a daughter card of a first type.

Referring to FIG. 1, a first type of daughter card, generally designated 2, which is of a presently existing, widely available type, includes an insertion edge 4, which is beveled to simplify the insertion of an adjacent insertion portion, generally designated 5, of this card 2 into a connector slot. This insertion portion 5 includes a single row of contact pads 6 on each side of the card 2, adjacent to the edge 4. Card 2 consists generally of an insulating material, such as glass epoxy, with various internal and external electrical circuits, some of which are connected to contact pads 6, and which are variously connected to electronic components 8 attached to one or both sides of the card. Contact pads 6 are typically made from a metallic material, such as copper, which is included in various layers of the card during its fabrication process, electroplated with a suitable contact material, such as a gold alloy.

Figure 2:
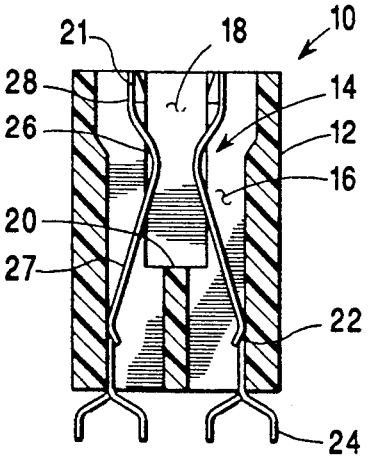
PRIOR ART Fig. 2.
FIG. 2 is a transverse sectional view of a connector of a first type.

Referring to FIG. 2, a first type of connector, generally designated 10, which is of an existing type widely used, being attached by solder to a mother board for the removable insertion of a daughter card, such as daughter card 2, includes an insulative housing 12, holding a number of contact springs 14 in contact cavities 16. Insulative housing 12 also includes a central slot 18 for the insertion of portion 5 of card 2, an axially extending card stop ledge 20 for limiting the insertion travel of card insertion edge 4, and a pair of axially extending travel stop ledges 21 for limiting the deflection of contact springs 14. Each contact spring 14 includes a mounting portion 22, which is mounted in slots extending from cavity 16; a solder tail portion 24, which extends outward from insulative housing 12 to be soldered to an associated circuit in the mother board (not shown); a contact portion 26, which extends into central slot 18; a flexible section 27; and a travel limiting portion 28, which limits the inward travel of the contact spring 14 when a daughter card is removed from the connector, by resting on a travel stop ledge 21 of housing 12. In each row of contact springs 14, the solder tail portions 24 of adjacent springs 14 are alternately formed outward and inward to increase the center distances between holes in the mother board, thereby simplifying the routing of circuit paths among the holes.

As a daughter card 2 is inserted into central slot 18, the beveled portion of insertion edge 4 pushes contact portions 26 of contact springs 14 outward, so that gaps are formed between travel limiting portions 28 and adjacent areas of travel stop ledges 21. When the card 2 is fully inserted, with insertion edge 4 against card stop ledge 20, contact portions 26 of springs 14 are held against adjacent contact pads 6 of card 2 by the deflection of flexible section 27, thereby making electrical contact between each pad 6 and an adjacent, associated spring 14.

Figure 3:
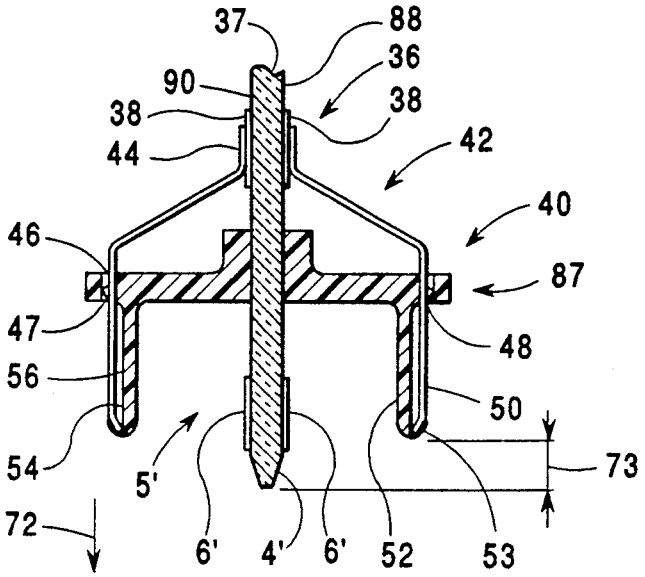
FIG. 3 is a partial transverse sectional view of a daughter card assembly of a second type, used in the preferred embodiment of this invention, showing the electrical contact pad and contact terminal region of this assembly.
Figure 4:
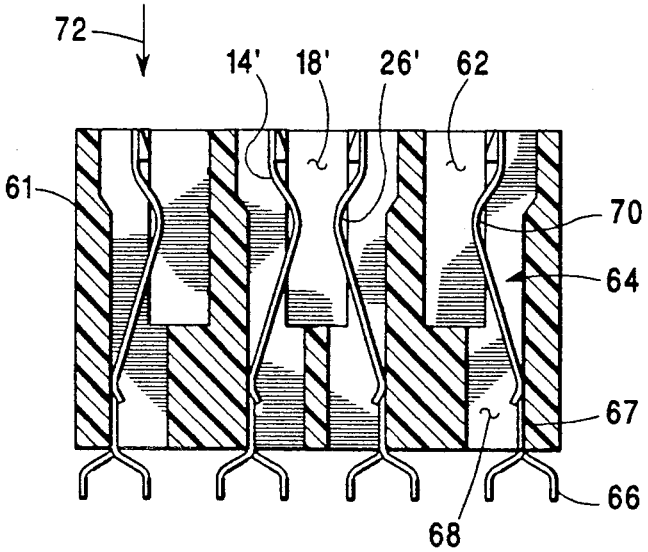
FIG. 4 is a transverse sectional view of a connector of a second type used in the first embodiment of this invention.

FIGS. 3 and 4 show a second type of daughter card assembly and mother board connector, respectively, where elements common in configuration and function with those described above in reference to FIGS. 1 and 2 are designated by the same reference numerals, with the addition of a prime symbol (').

Referring to FIG. 3, a second type of daughter card assembly, generally designated 36, includes an insertion edge 4', and a row of contact pads 6' adjacent to this edge 4' on each side of a circuit card 37. These features are similar or identical to the corresponding features on the first type of daughter card 2. This card assembly 36 also includes on each side an upper row of solder pads 38. Preferably, contact pads 6 are plated with a gold alloy to facilitate operation with contact springs in a mating connector, while solder pads 38 are coated with solder to the subsequent attachment of terminal members by a reflow solder process. Both contact pads 6 and solder pads 38 are connected to various electronic circuits within daughter card 37. Card assembly 36 also includes on each side an attached insulative support structure, generally designated 40, holding a number of terminal members 42. Each terminal member includes in turn a solder tail portion 44, extending inward to be soldered in place on a solder pad 38; a mounting portion 46, which is held by a lanced tab 47 extending within a slot 48 of support structure 40; a contact portion 50, extending along an insulating blade 52 of structure 40; and a curved tip 53, extending into a cavity 54 of blade 52. One such cavity 54 is included for each terminal member 42, so that contact portions 50 are held in alignment therein. The outer surface 56 of each blade 52 is recessed from an adjacent inner surface of each contact portion 50, so that flexibility of these contact portions is retained to control the spring rate when this card assembly is inserted in a mating connector.

Referring to FIG. 4, a second type of connector, generally designated 60 is configured to removably receive either a first type of daughter card 2 or the second type of daughter card assembly 36, having, in an insulative housing 61, a central slot 18' for receiving either insertion portion 5 of daughter card 2 or insertion portion 5' of daughter card assembly 36, and having on each side an outer slot 62 for receiving a blade 52 of daughter card assembly 36. This connector 60 includes on each side of central slot 18' a row of contact springs 14', which are identical in form and function to springs 14 described in reference to FIG. 2, and a row of outer contact springs, generally designated 64, extending into each of the outer slots 62. Individual outer contact springs 64 may be identical to various of the contact springs 14', or they may be different in the shapes given to their solder tail portions 66. Outer contact springs 64 include mounting portions 67, which are held in slots in outer contact cavities 68 in insulative housing 61.

When a second type of daughter card assembly 36 is inserted into the second type of connector 60, contact springs 14 are separated by the bevel of insertion edge 4', and the contact portions 26' of these springs 14' are brought into electrical contact with the contact pads 6'. Subsequently, the curved tips 53 and contact portions 50 of terminal members 42 are brought into electrical contact with contact portions 70 of outer contact springs 64.

Within connector 60, relative to the direction of card assembly insertion, as indicated by arrow 72, contact portions 70 of outer contact springs are located at the same level as contact port 26' of springs 14'. However, in daughter card assembly 36, while contact portions 50 of terminal members 42 overlap contact pads 6 in insertion direction 72, these contact portions 50 do not extend in this direction as far as insertion edge 4, being offset in this direction by a distance 73. Therefore, when card assembly 36 is inserted in connector 60, contact springs 14' are separated by the interaction of insertion edge 4' between contact portions 26' before contact is initiated between curved tips 53 of terminal members 42 and contact portions 70.

Whenever contacts are deflected by beveled or curved edges of a card assembly, the force required to insert the card in a connector is increased. After this deflection occurs, continued insertion results in a frictional force which is less than the force required to deflect the contacts. Therefore, this staggering of the times at which such increased forces are encountered reduces the maximum force required to insert the card assembly. The length of contact pads 6' allows this staggering, with distance 73 being chosen to provide adequate contact wipe between contact springs 64 and terminal members 42 as daughter card assembly 36 is fully inserted into connector 60.

The second type of daughter card assembly 36 can also be inserted in the first type of connector 10, with insertion portion 5' being slid into central slot 18 so that contact pads 6' make electrical contact with contact springs 14. When this occurs, the offset distance between each blade 52 and daughter card 37 is great enough to prevent contact between these blades 52 and connector housing 12.

Figure 5:
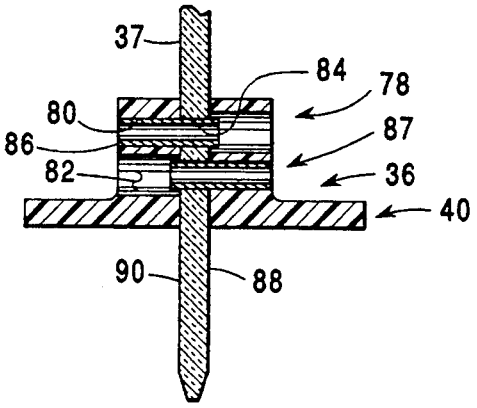
FIG. 5 is a partial transverse sectional view of the daughter card assembly of FIG. 3, showing the support structure mounting region of this assembly.

Referring to FIG. 5, each insulative support structure 40 of daughter card assembly 36 includes two or more mounting ribs, generally designated 78, which are used in the attachment of these structures 40 to daughter card 37. If the axial length of a structure 40 is relatively short, it may include only a mounting rib 78 at each end, while a longer version of this structure 40 may require one or more additional mounting ribs 78 between ends. Each mounting rib 78 includes a mounting hole 80 and a larger clearance hole 82. Daughter card 37 includes a pair of mounting holes 84, spaced to position support structures 40 in alignment with each other on opposite sides of the card 37. Rivets 86 are driven through mounting holes 80 and 84, fitting tightly therein, to hold the structures 40 in place. These rivets 86 may be of a hollow type which can be expanded to fit tightly by pulling a mandrel through their internal holes.

Referring to FIG. 3, the preferred method for making daughter card assembly 36 begins with a circuit card 37, which is generally made of an insulative material, such as epoxy glass laminate, and which has various layered patterns, made of a conductive material, such as copper; and with a pair of connector subassemblies, generally designated 87, each of which includes an insulative support structure 40 to which a number of terminal members 42 are attached. The outer layer copper patterns of card 37 include contact pads 6' and solder pads 38. Contact pads 6' are plated with a suitable contact material, such as gold, by means of an electroplating process. Solder pads 38 on a first side 88 of card 37 are then coated with a solder paste, containing solder alloy and flux, by a screen printing process. Additional pads (not shown), which are located on this side 88 for the attachment of terminals from various other electronic components (not shown) to be placed on side 88, are similarly coated with solder paste during this same screen printing process.

Referring to FIG. 5, a connector subassembly 87 is then placed on side 88 of card 37 and fastened in place by rivets 86 driven through mounting hole 80 in support structure 40 and through mounting hole 84 in card 37. Various other electronic components (not shown) are then placed in appropriate locations on this side 88. The card 37 is then placed with second side 90, opposite first side 88, face down on a conveying system of a type well known to those skilled in the art of manufacturing circuit cards by a solder reflow process, to move first side 88 past an infrared heat source, so that the solder paste which has been screen printed on the various pads of side 88 is melted to reflow on these pads and along the surfaces of various terminals adjacent to these pads, including the solder tail portions 44 of the installed connector assembly 87.

Referring again to FIGS. 3 and 5, the assembly thus formed is then turned over, and the steps described above are repeated for the second side 90 of the card 37. Solder paste is screen printed on pads on this side 90, a second connector subassembly 87 is attached to side 90 by rivets 86, other components (not shown) are also placed on side 90, and first side 88 is placed adjacent to a conveying system of a well-known type, which may include fixturing means to hold the assembly level in spite of the components which have been attached to first side 88, so that second side 90 is moved adjacently past an infrared heat source, melting the solder on side 90 to reflow around the various terminal portions held in engagement with side 90.

Figure 6:
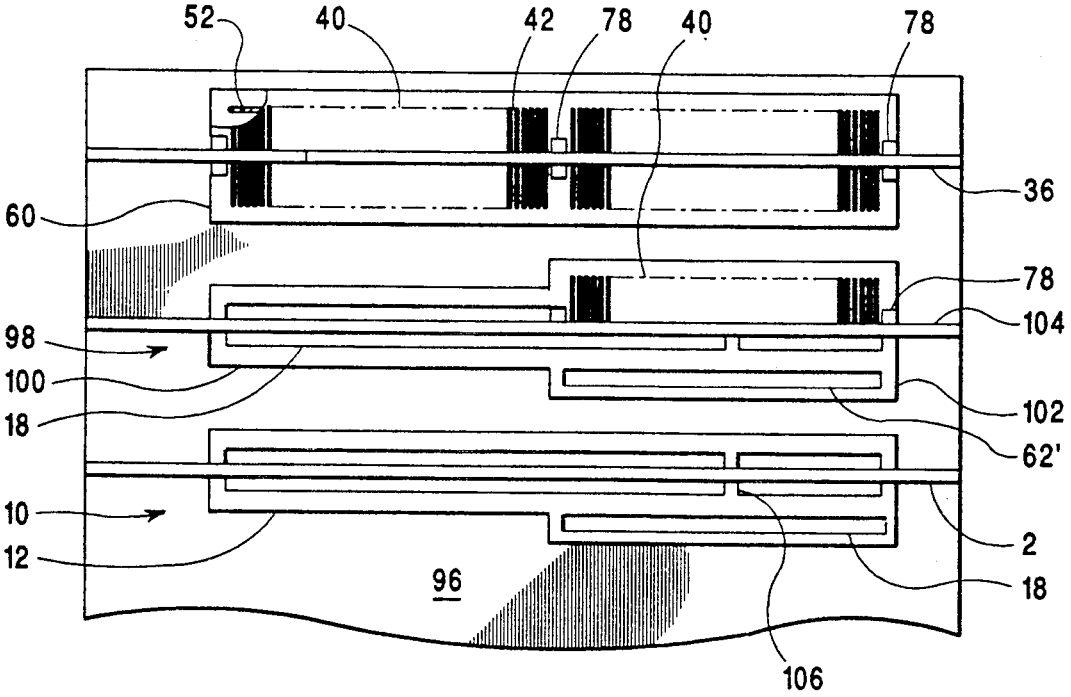
FIG. 6 is an elevational view from above an assembly consisting of a mother board having connectors of first, second and hybrid types, and daughter card assemblies of first, second, and hybrid types.

Referring to FIG. 6, an electronic circuit assembly may include a mother board 96 having a first type of connector 10, a second type of connector 60, and a hybrid type of connector, generally designated 98, attached thereto. In this example, hybrid connector 98 includes a first section 100, having a transverse sectional profile similar to that of the first type of connector 10 (as shown in FIG. 2), and a second section 102 having a transverse sectional profile similar to that of the second type of connector 60, (as shown in FIG. 4). Thus, in connector 98, outer slot 62' is coextensive with a fractional part of central slot 18. Various types of daughter card assemblies can be removably and interchangeably installed in these connectors. For example, a first type of daughter card 5, a second type of daughter card assembly 36, or a hybrid daughter card assembly 104 can be installed in any of these connector types 10, 60, and 98. The second type of daughter card assembly 36 includes, along its entire contact region on both sides, insulative support structures 40 with terminal members 42. While hybrid daughter card assembly 104 includes one or more such support structures 40 with terminal members 42, the available areas for attachment of such structures 40 are not filled. On card 104, the support structure 40 is coextensive with a fractional portion of the insertion portion (not shown) extending in central slot 18 of connector 98.

When compared to the modular connector approach of U.S. Pat. No. 4,550,959 to Grabbe et al., the approach of the present invention achieves the advantage of providing more connections along the length of a daughter card. The approach of Grabbe et al. retains only one row of contacts on each side of the cardreceiving slot of a mother board connector, using a modular construction to vary the length of the connector. The present invention uses a modular approach to add rows of connections on one or both sides of the daughter card.

As previously discussed in reference to FIG. 3, blades 52 of insulative support structures 40 are far enough apart to allow these structures 40 to extend around and above insulative housings 12 of first types of connector 10 when a second type of daughter card assembly 36 is plugged into a first type of connector 10. Therefore, the different types of card assemblies 2, 36, and 104 are fully mechanically interchangeable in the different types of connectors 10, 60, and 98.

A key 106, extending across the central slot 18 or 18' of all connectors 10, 60, and 98, operating in a slot (not shown) in the insertion portion 5 or 5' of a daughter card or daughter card assembly, is used to assure precise axial alignment between the daughter card or daughter card assembly and the connector. Card assemblies 2, 36, and 104 may also contain various means (not shown) for attaching cables or devices as determined by the function of these card assemblies.

Mother board 96 may be designed in such a way that certain connectors are reserved especially for certain functions and certain associated types of daughter card assemblies. The hybrid type of connector 98 can be used when only a subset of the nonessential circuits is used in such a reserved location. It may furthermore be desirable to place some limitations on the interchangeability of daughter cards among various connectors developed through the use of this invention. Such limitations can be imposed among connectors by varying the length of central slots 18 and 18', or of outer slots 62, or by varying the location of key 106. Such variations can also be needed between central slot 18 and outer slots 62 on an individual connector to assure that a first type of daughter card 2 is not inadvertently installed in an outer slot 62.

Figure 7:
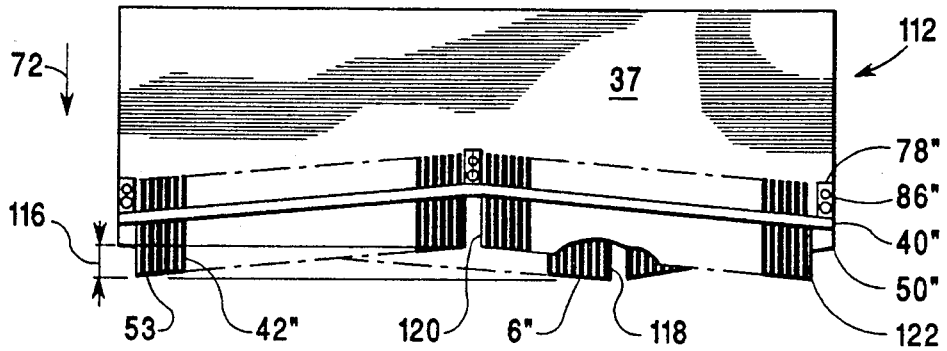
FIG. 7 is a side elevational view of a first alternative embodiment of a daughter card assembly of a second type, where angled contact edges are used to minimize card insertion force.

FIG. 7 shows a first alternative embodiment, generally designated 112, of the second type of daughter card assembly, where elements common in configuration and function to those previously described are designated by the same reference numerals, followed by a double prime symbol (''). While the preferred embodiment 36 (shown in FIG. 3) of this assembly has a straight insertion edge 4', and the ends of curved tips 53 of terminal members 42 are aligned in straight lines parallel to this edge 4'; in daughter card 112, the insertion edge 4'' extends upward in both directions through a distance 116 from a slot 118 in circuit card 37'', and the ends of curved tips 53'' of terminal members 42'' are aligned in straight lines extending downward from a central region 120 through this distance 116 to corners 122 at each end of the card. This card assembly 112 also includes a similar support structure 40'' with terminal members 42'' on the opposite side of circuit card 37'', so there are four corners 122.

Thus, when this card assembly 112 is inserted in a second type of connector 60 (shown in FIG. 4) contact first occurs between the edges of slot 118 and key 106 (shown in FIG. 6), axially aligning the card assembly with the connector as required. Further insertion motion brings the curved tips 53" of terminal members 42" into contact with the adjacent contact portions 70 of outer contact springs 64 in connector 60, providing balanced forces opposing the insertion motion at four extreme corners. Card assembly 112 is thus stabilized as it is inserted, preventing twisting motions which could result in jamming or contact damage. Further insertion motion gradually brings terminal members 42" into contact with outer contact springs 64 of connector 60, moving from corners 122 inward, as contact pads 6" are gradually brought into contact with inner contact springs 14', moving from slot 118 outward in both directions.

The distance 116 is limited by the length of contact pads 6" near slot 118 and by the length of contact portions 50" of terminal members 42" near corners 112, so that adequate contact is achieved between all contact pads 6" and inner contact springs 14 or 14', and between all terminal members 42" and outer contact springs 64', when the card assembly 112 is fully inserted in a connector. Since the deflection of contact springs 14 or 14' and 64 is thus spread over the insertion motion, the insertion force required is minimized.

Compared to the approach of prior-art connector systems, such as the DuPont HPC Interconnect System, where pins of differing lengths are used to sequence the engagement of individual circuits, the approaches of the first and second embodiments of the present invention offer the advantage of not requiring the use of different lengths of parts. Contact sequencing is achieved by the location of insulative support structures 42 and 42" relative to insertion edges 4' and 4". The second embodiment of the present invention retains this advantage and offers the additional advantage of further breaking up the insertion distances at which deflections of contact springs are initiated, so that these distance occur nearly continuously as the connectors are engaged.

Figure 8:
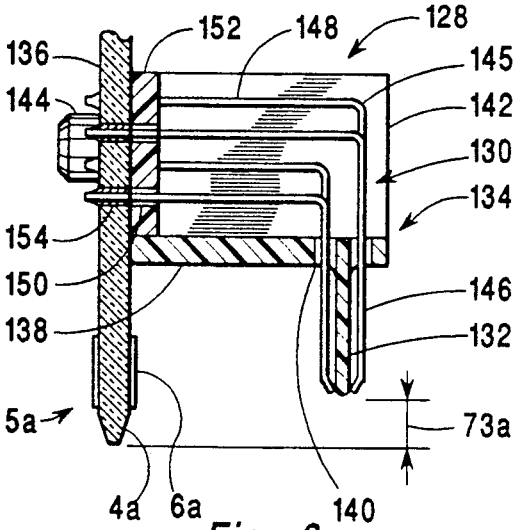
FIG. 8 is a transverse sectional view of a second alternative embodiment of a daughter card assembly of the second type, showing the contact pad and contact terminal region of this assembly.

FIG. 8 shows a second type of daughter card assembly, generally designated 128, of a second alternative embodiment of the invention, in which elements common in configuration and function to those previously described having similar or identical forms and functions as other elements previously described are designated with the same reference numerals with a suffix "a". Daughter card assembly 128 includes formed terminal members, generally designated 130, extending along both sides of an insulative blade 132, which is part of an insulative support structure, generally designated 134, which in turn extends outward from one side of a circuit card 136 including an edge 4*a* beveled for the insertion of a card portion 5*a* into a card-edge connector, including a row of conductive pads 6*a* electrically connected to various circuits within the card 136. This insulative support structure 134 also includes a support shelf 138, with holes 140 through which terminal members 130 pass, and, at each end, a mounting rib 142 from which an integral pin 144 extends for the alignment and attachment of insulative support structure 134 through holes in circuit card 136. Each terminal member 130 includes a right angle bend 145, from which a contact portion 146 extends in one direction along a side of insulative blade 132, and from which a solder tail portion 148 extends in the other direction through a hole 150 in insulative alignment plate 152 and a hole 154 in circuit card 136. This insulative alignment plate 152 also includes holes (not shown) through which integral pins 144 extend.

After the terminal members 130 are formed and assembled in insulative support structure 134, insulative alignment plate 152 is pushed into place over pins 144, with solder tail portions 148 extending through holes 150. The assembly thus formed is then attached to circuit card 136 by means of alignment and attachment pins 144, and is soldered in place by means of solder tails 148 extending through holes 154 in the card, which are plated through with a conductive, solderable material, such as copper, and which are attached to conductive circuit traces in the card.

Figure 9:
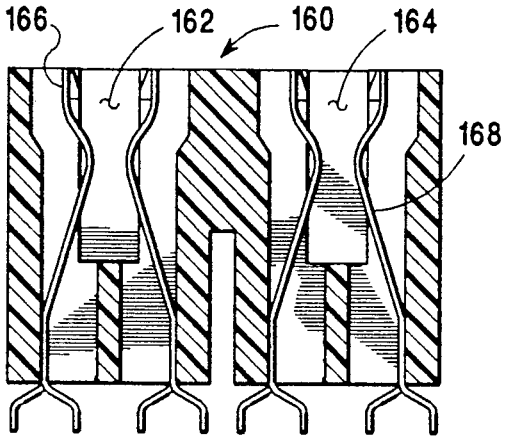
FIG. 9 is a transverse sectional view of a second alternative embodiment of a connector of the second type, configured to mate with the daughter card assembly shown in FIG. 8.

FIG. 9 shows a second type of connector assembly, generally designated 160, of a second alternative embodiment of the invention, in which elements common in configuration and function to those previously described having similar or identical forms and functions as other elements previously described are designated with the same reference numerals with a suffix "a". Connector assembly 160 includes a primary axial slot 162 for receiving insertion portion 5*a* of circuit card 136 in daughter card assembly 128, and a secondary axial slot 164 for receiving insulative blade 132 and contact portions 146 of terminal members 130.

A daughter card assembly 128 (shown in FIG. 8) can also be installed in first type of connector 10 (shown in FIG. 2), with insulative support structure 134 and terminal members 130 extending around and adjacent to connector housing 12. A first type of daughter card 2 can also be installed in primary axial slot 162 of connector 160. Thus, the first and second embodiments of this invention share the same first versions of daughter cards and connectors. Geometric changes between primary axial slot 162 and secondary axial slot, such as variation of the length of these slots or the use of a key (not shown) extending transversely across secondary slot 164 in a location different from that of such a key (not shown) across primary slot 162, may be used to prevent the insertion of a first type of daughter card 2 (shown in FIG. 1) in secondary axial slot 164.

This embodiment of the invention can also be applied to a hybrid type of daughter card assembly, as previously described in reference to FIG. 6. While in the version shown in FIG. 8, contact portions 146 are offset, in the direction of insertion, by a distance 73 from insertion edge 4*a*, the method described in reference to FIG. 7 may alternately be applied to this embodiment.

Figure 10:
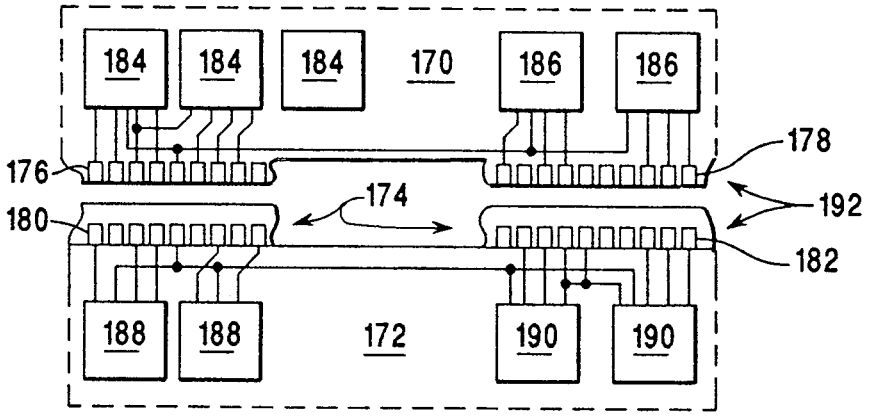
FIG. 10 is schematic representation of a daughter card of a second type and an associated mother board of a second type.

Certain aspects of system configuration in the present invention will now be discussed with respect to FIG. 10, which schematically shows a second type of daughter card assembly 170 adjacent to a mother board 172 on which a second type of connector, generally designated 174, is mounted. Daughter card assembly 170 may be, for example, of any of the embodiments previously discussed; it may be a daughter card assembly 36 (shown in FIG. 3), a hybrid daughter card assembly 104 (shown in FIG. 4), a daughter card assembly 112 from the alternative embodiment (shown in FIG. 7), or a daughter card assembly from the second alternative embodiment (shown in FIG. 8). Connector 174 may also be, for example, any one of the embodiments previously discussed; it may be a connector 60 (shown in FIG. 4), a hybrid connector 98 (shown in FIG. 6), or a connector 160 from the second alternative embodiment (shown in FIG. 9). Daughter card assembly 170 includes a number of conductive pads 176 adjacent to an insertion edge, which may be pads 4', 4", or 4*a*; and a number of additional contact terminals 178 aligned on an insulating structure, which may be contact terminals 42 or 130. Connector 174 includes a number of contact springs 180 aligned individually to engage conductive pads 176, and an additional number of contact springs 182 aligned individually to engage conductive pads 178. Contact springs 180 may be contact springs 26' or 166, while contact springs 182 may be contact springs 70 or 168. Mother board 172 may also include a number of additional connectors like 172, a number of connectors of a first type, like connector 10 (shown in FIG. 2), and a number of other connectors.

Card assembly 170 contains a number of electronic circuits 184 and 186 variously connected to contact pads 176 and to terminal members 178. Mother board 172 also includes a number of electronic circuits 188 and 190 electrically connected to contact springs 180 and 182 within the connectors 174 by means of conductive circuit paths within this board 172. Components and circuit paths within mother board 172 operate in cooperation with components and circuit paths within various daughter card assemblies which may be inserted in the connectors on this board 172, to form larger electronic circuits and to perform various functions associated with electronic systems, such as computer systems.

In accordance with a preferred version of this invention, daughter card assembly 170 and mother board 172 include a number of essential circuits 184 and 188, respectively, which are required for the proper cooperative functioning of circuits within a system of daughter cards and mother board 172, and which pass through connections between contact pads 176 on daughter card assembly 170 and contact springs 180 in connector 174 attached to mother board 172. Daughter card assembly 170 and mother board 96, also include nonessential interconnection circuits, 186 and 190, which are not required for such proper cooperative functioning, which enhance system performance, or which provide additional system features, and which pass through connections between terminal members 178 of daughter card assembly 170 and contact springs 182 of connector 174, as additional circuit paths 192. Non-essential circuits 186 and 192 may be connected partially to circuit paths through pads 176 and 180, but essential circuits 184 and 188 do not require connection through additional circuit paths 192 for proper functioning.

In instances where these additional circuit paths 192 do not facilitate the functioning of a daughter card with mother board 172, the first type of daughter card 2 is used. The hybrid type of daughter card assembly 104 is used to provide functions which require a subset of the total available additional circuit paths 192.

Presently-available first type of daughter cards 2 (shown in FIG. 1) include various essential circuits 184, and presently-available mother boards having the first type of connector 10 (shown in FIG. 2) include various essential circuits 188. Therefore, when a second type of daughter card assembly 170 is plugged into a first type of connector 10 on a mother board configured for use with first-type daughter cards 2, the essential interconnection circuits, including essential circuits 184 and 188, are completed through contact pads 176 and contact springs 14 within the connector 10. Also, when a first type of daughter card 2 is plugged into a second type of connector 174 on mother board 172, the essential interconnections are completed in the same way.

Full compatibility between daughter cards of the first and second types and mother boards having connectors of the first and second types is achieved in this way. This compatibility extends both to the mechanical engagement of daughter cards in connectors and to the proper electronic functioning of combinations of daughter cards with a mother board having connectors of either or both types. For the owner of a system having daughter cards of the first type and a mother board with connectors of the first type, this means that his investment is protected from obsolescence. He can continue using his mother board, even with daughter cards having additional features with more electrical contacts. Also, if he purchases a system having a mother board with connectors of the second type, he can continue using his daughter cards of the first type with it. From the point of view of a supplier of daughter cards and systems using mother boards, the implementation of this invention means that improvements requiring additional circuits extending between such cards and boards can be made without a concern that the new cards will not function properly in old mother boards, or that the new mother boards will not accept widely-available daughter cards of the first type.

The implementation of the present invention thus achieves a significant advantage over the prior-art system described in U.S. Pat. No. 4,934,961 to Piorunneck et al., wherein a connector accepts daughter cards of both old and new types, but wherein the new type of daughter card cannot be inserted to operate in the old type of connector. With the implementation of the invention described by Piorunneck et al., an old type of system cannot accept new cards, so the investment of the system owner in the system itself is not protected from obsolescence as it is with the implementation of the present invention.

The implementation of the present invention also achieves significant advantages of lower cost, simplicity, and greater reliability over prior-art systems, such as that described in U.S. Pat. No. 4,936,785 to Krug et al., where an additional adapter module is used to provide different interfaces. This approach requires an additional connector interface, compared to the present invention, in any configuration.

While the invention has been described in its preferred forms or embodiments with a certain degree of particularity, it is understood that this disclosure has been made only by way of example, and that numerous changes in the details of construction, fabrication and use, including the combination and arrangement of parts, may be resorted to without departing from the spirit and scope of the invention.

What is claimed is:

1. A daughter card assembly comprising:

a circuit card with an insertion edge facing in a first direction, conditioned for insertion into a card edge connector, divided into a plurality of sections, various of said sections being slanted to extend axially and in said first direction, wherein said insertion edge is interrupted by a slot for locating said daughter card assembly in an axial direction relative to said card edge connector, wherein said insertion edge includes location sections being slanted to extend axially away from said slot and in a direction opposite said first direction;

a plurality of conductive circuit paths on a surface of each side of said circuit card adjacent to said insertion edge;

means for holding a plurality of contact terminals spaced away from said circuit card, and parallel to said circuit card, wherein said means for holding comprises first and second support structures extending from opposite sides of said circuit card, outward beyond opposite outer side surfaces of a card edge connector engaging said circuit card over said insertion edge, each said support structure including a blase-shaped section extending, spaced apart from said circuit card, in said first direction;

a plurality of conductive terminal elements including contact terminals individually extending in said first direction along said means for holding, being supported on said means for holding and being electrically insulated from each other, said terminal elements including sections extending inward, connected individually to electrical circuit traces on said circuit card, wherein said plurality of conductive terminal elements comprises a first plurality of conductive terminal elements including contact terminals individually extending along said blade-shaped section of said first support structure, and a second plurality of conductive terminal elements including contact terminals individually extending along said blase-shaped section of said second support structure;

a plurality of essential electronic circuits on said circuit card, electrically connected to various of said conductive circuit pads, said essential electronic circuits being necessary for proper functioning of said daughter card assembly in cooperation with various circuits attached thereto through said conductive circuit pads; and a plurality of non-essential electronic circuits on said circuit card, electrically connected to various of said conductive terminal elements, said non-essential electronic circuits being necessary for providing non-essential features of said daughter card assembly in cooperation with various additional circuits attached thereto through said conductive terminal elements, wherein said non-essential electronic circuits are variously wired among said first and second pluralities of conductive terminal elements;

wherein said blade-shaped section, together with said contact terminals, extend in said first direction outwardly adjacent to said opposite outer side surfaces of a card edge connector, overlapping said conductive circuit pads in said first direction, being divided into a plurality of sections, various of said section being slanted to extend axially in said first direction, including sections extending axially away from ends thereof, slanted to extend in a direction opposite said first direction.

2. A daughter card assembly comprising:

a circuit card with an insertion edge facing in a first direction, conditioned for insertion into a card edge connector, wherein said insertion edge is divided into a plurality of sections, various of said sections being slanted to extend axially and in said first direction, wherein said insertion edge is interrupted by a slot for locating said daughter card assembly in an axial direction relative to said card edge connector, wherein said insertion edge includes location sections being slanted to extend axially away from said slot and in a direction opposite said first direction;

a plurality of conductive circuit pads on a surface of each side of said circuit card adjacent to said insertion edge;

means for holding a plurality of contact terminals spaced away from said circuit card, and parallel to said circuit card, wherein said means for holding comprises a support structure extending from a side of said circuit card, outward beyond an outer side surface of a card edge connector engaging said circuit card over said insertion edge, said support structure including a blade-shaped section extending, spaced apart from said circuit card, in said first direction;

a plurality of conductive terminal elements including contact terminals individually extending in said first direction along said means for holding, being supported on said means for holding and being electrically insulated from each other, said terminal elements including sections extending inward, connected individually to electrical circuit traces on said circuit card, wherein said plurality of conductive terminal elements comprises a first plurality of conductive terminal elements including contact terminals individually extending along an outer side of said blade-shaped section and a second plurality of conductive terminal elements including contact terminals individually extending along an inner side of said blase-shaped section;

a plurality of essential electronic circuits on said circuit card, electrically connected to various of said conductive circuit pads, said essential electronic circuits being necessary for proper functioning of said daughter card assembly in cooperation with various circuits attached thereto through said conductive circuit pads; and a plurality of non-essential electronic circuits on said circuit card, electrically connected to various of said conductive terminal elements, said non-essential electronic circuits being necessary for providing non-essential features of said daughter card assembly in cooperation with various additional circuits attached thereto through said conductive terminal elements, said non-essential circuits being variously wired among said first and second pluralities of conductive terminal elements;

wherein said blade-shaped section, together with said contact terminals, extends in said first direction outwardly adjacent to said outer side surface of a card edge connector, being divided into a plurality of sections, various of said sections being slanted to extend axially in said first direction, overlapping said conductive circuit pads in said first direction, including sections extending axially away from ends thereof, slanted to extend in a direction opposite said first direction.

3. A daughter card assembly comprising:

a circuit card with an insertion edge facing in a first direction, conditioned for insertion of an insertion portion of said card adjacent to said insertion edge into a card edge connector, said insertion edge being divided into a plurality of sections, various of said sections being slanted to extend axially and in said first direction, wherein said insertion edge is interrupted by a slot for locating said daughter card assembly in an axial direction relative to a card edge connector, wherein said insertion edge includes location sections being slanted to extend axially away from said slot for locating and in a direction opposite said first direction, said card being generally made of an insulative material with a plurality of conductive circuit traces;

a plurality of primary conductive circuit pads on each side of said insertion portion, individually connected to a first plurality of said circuit traces;

a first plurality of secondary conductive circuit pads on a first side of said card outside said insertion portion, individually connected to a first plurality of said circuit traces;

a second plurality of secondary conductive circuit pads on a second side of said card outside said insertion portion, individually connected to a third plurality of said circuit traces;

a first insulative structure fastened to said card, extending outward from said first side, including a plurality of terminal attaching slots and a blade-shaped portion extending in said first direction;

a second insulative structure fastened to said card, extending outward from said second side, including a plurlaity of terminal attaching slots and a blade-shaped portion extending in said first direction;

a first plurality of conductive terminal elements, each said terminal element extending through one of said terminal attaching slots, each said terminal element including a contact terminal extending in said first direction along said blade-shaped portion and an inward-directed portion extending to said circuit card, electrically connected to one of said secondary conductive circuit pads on said first side; and a second plurality of conductive terminal elements, each said terminal element extending through one of said terminal attaching slots in said second insulative structure, each said terminal element including a contact terminal extending in said first direction along said blade-shaped portion of said second insulative structure and an inward-directed portion extending to said circuit card, electrically connected to one of said secondary conductive circuit pads on said second side;

wherein said blade-shaped portions, together with said contact terminals, are divided into a plurality of sections, various of said sections being slanted to extend axially in said first direction, overlapping said conductive circuit pads in said first direction, including sections extending axially away from ends thereof, slanted to extend in a direction opposite said first direction.

4. A daughter card assembly comprising:

a circuit card with an insertion edge facing in a first direction, conditioned for insertion into a card edge connector, divided into a plurality of sections, various of said sections being slanted to extend axially and in said first direction, wherein said insertion edge is interrupted by a slot for locating said daughter card assembly in an axial direction relative to said card edge connector, wherein said insertion edge includes location sections being slanted to extend axially away from said slot and in a direction opposite said first direction;

a plurality of conductive circuit paths on a surface of each side of said circuit card adjacent to said insertion edge;

means for holding a plurality of contact terminals spaced away from said circuit card, and parallel to said circuit card, wherein said means for holding comprises first and second support structures extending from opposite sides of said circuit card, outward beyond opposite outer side surfaces of a card edge connector engaging said circuit card over said insertion edge, each said support structure including a blade-shaped section extending, spaced apart from said circuit card, in said first direction;

a plurality of conductive terminal elements including contact terminals individually extending in said first direction along said means for holding, being supported on said means for holding and being electrically insulated from each other, said terminal elements including sections extending inward, connected individually to electrical circuit traces on said circuit card, wherein said plurality of conductive terminal elements including contact terminals individually extending along said blade-shaped section of said first support structure, and a second plurality of conductive terminal elements including contact terminals individually extending along said blade-shaped section of said second support structure;

wherein said blade-shaped sections, together with said contact terminals, extend in said first direction outwardly adjacent to said opposite outer side surfaces of a card edge connector, overlapping said conductive circuit pads in said first direction, being divided into a plurality of sections, various of said sections being slanted to extend axially in said first direction, including sections extending axially away from ends thereof, slanted to extend to a direction opposite said first direction.

5. A daughter card assembly comprising:

a circuit card with an insertion edge facing in a first direction, conditioned for insertion into a card edge connector, wherein said insertion edge is divided into a plurality of sections, various of said sections being slanted to extend axially and in said first direction, wherein said insertion edge is interrupted by a slot for locating said daughter card assembly in an axial direction relative to said card edge connector, wherein said insertion edge includes location sections being slanted to extend axially away from said slot and in a direction opposite said first direction;

a plurality of conductive circuit pads on a surface of each side of said circuit card adjacent to said insertion edge;

means for holding a plurality of contact terminals spaced away from said circuit card, and parallel to said circuit card, wherein said means for holding comprises a support structure extending from a side of said of said circuit card, outward beyond an outer side surface of a card edge connector engaging said circuit card over said insertion edge, said support structure including a blade-shaped section extending, spaced apart from said circuit card, in said first direction;

a plurality of conductive terminal elements including contact terminals individually extending in said first direction along said means for holding, being supported on said means for holding and being electrically insulated from each other, said terminal elements including sections extending inward, connected individually to electrical circuit traces on said circuit card, wherein said plurality of conductive terminal elements comprises a first plurality of conductive terminal elements including contact terminals individually extending along an outer side of said blade-shaped section and a second plurality of conductive terminal elements including contact terminals individually extending along an inner side of said blade-shaped section;

wherein said blade-shaped section, together with said contact terminals, extends in said first direction outwardly adjacent to said outer side surface of a card edge connector, being divided into a plurality of sections, various of said sections being slanted to extend axially in said first direction, overlapping said conductive circuit pads in said first direction, including sections extending axially away from ends thereof, slanted to extend in a direction opposite said first direction.

* * * * *